US005685780A

United States Patent [19]

Desjardins

[11] Patent Number: 5,685,780

[45] **Date of Patent: *Nov. 11, 1997**

[54] GOLF CUP AND GOLF TEE FOR PUTTING PRACTICE PLATFORMS

[76] Inventor: Pierre Desjardins, 919 Châteauneuf Street, Bellefeuille, Quebec, JOR 1AO, Canada

[ * ] Notice: The term of this patent shall not extend beyond the expiration date of Pat. No. 5,478,076.

[21] Appl. No.: 696,537

[22] Filed: Jul. 12, 1996

Related U.S. Application Data

[63] Continuation-in-part of Ser. No. 415,197, Apr. 3, 1995, abandoned.

[51] Int. Cl.[6] ..... A63B 57/00

[52] U.S. Cl. ..... 473/178; 473/176; 473/135

[58] Field of Search ..... 473/150, 151, 473/152, 153, 173, 174, 175, 176, 177, 178, 179, 180, 190, 192, 135; 472/51, 52, 53, 56

[56] References Cited

U.S. PATENT DOCUMENTS

| | | | |
|---|---|---|---|
| 4,120,496 | 10/1978 | Niina | 473/176 |
| 4,270,751 | 6/1981 | Lowy | 473/175 |
| 5,018,730 | 5/1991 | Iliuta | 473/175 |
| 5,145,176 | 9/1992 | Lipson | 473/135 |
| 5,478,076 | 12/1995 | Desjardins | 473/178 |
| 5,480,142 | 1/1996 | Ackerman | 473/178 |

*Primary Examiner*—Steven B. Wong

[57] ABSTRACT

A golf cup is provided for securement to a golf practice putting platform wherein the cup comprises a cylinder defining a hollow chamber having a closed bottom end and a circular open top end. The securement means is provided adjacent the open top end for securing the golf cup to the putting platform. The golf cup is provided with a plurality of gadgetry, mechanically or electronically constructed, to induce laughter to one or more players playing the putting game on a miniature golf putting course. There is also provided a golf tee for securement to the practice putting platform and comprised of a cylinder having a hole therein for securement of a tee element which extends thereabove. The cylinder housing is detachable secured to a support base having securement means for securing the golf tee to the putting platform. Various gadgetry is also connected to the tee to further induce laughter to the players.

17 Claims, 4 Drawing Sheets

GOLF CUP AND GOLF TEE FOR PUTTING PRACTICE PLATFORMS

This is a continuation-in-part of U.S. patent application Ser. No. 08/415,197 filed Apr. 3, 1995, now abandoned.

TECHNICAL FIELD

The present invention relates to a golf cup and golf tee for securement in a putting practice platforms used in a miniature putting golf course and adapted with various gadgetry to induce laughter to the people playing the particular putting hole or to players elsewhere on the miniature golf putting course.

BACKGROUND ART

It is known to construct golf cups with an ejector mechanism therein to automatically eject a ball therefrom when the ball enters the hole. U.S. Pat. No. 3,623,732 describes such a cup wherein an ejector is actuated by a coil which is powered by batteries secured within the hole. The purpose of these ejectors is to facilitate ball retrieval. U.S. Pat. No. 4,120,496 describes another golf cup construction wherein a noise is emitted when the golf ball enters the hole wherein the noise produces a natural sound conducive to the game of golf. This sound indicates that the ball has entered the cup. U.S. Pat. No. 5,018,730 discloses a combination of a sound producing element as well as an ejector with the ball ejector being activated after a predetermined time delay whereby the player may retrieve the ball as it is ejected in the air. U.S. Pat. No. 4,922.222 discloses a sound producing system which is actuated when a player in a miniature golf putting course obtains a hole-in-one. The system monitors the tee to detect a golf ball leaving the tee and simultaneously detects the cup to sense if the ball has entered the cup a predetermined time after having left the tee. When these conditions are met an alarm is automatically triggered.

SUMMARY OF INVENTION

All of the above reference to patents deal with facilitating the retrieval of a golf ball from a golf cup, and particularly of the type used in a miniature golf putting course, or for signaling when a hole-in-one has been obtained. The purpose of these gadgetry is not specific to creating an atmosphere of laughter on the golf putting practice amusement course, as is the case with the present invention. In fact, in the game of golf it has been the rule that the players do not make noise and that a serene atmosphere prevails. Contrary to this, Applicant has devised a plurality of gadgetry for use with golf ball tees and golf cups which are secured to a putting platform or putting surface in an amusement golf putting practice course to cause the players to laugh and generate an atmosphere of fun and laughter throughout the entire miniature golf putting course.

It is a feature of the present invention to provide a golf cup for securement to a golf practice putting platform comprised of a cylinder defining a hollow chamber having a bottom end and a circular open top end. The hollow chamber is provided with various types of gadgetry whereby each time the ball enters the golf cup there is automatically provided a means to induce laughter to the players.

According to another feature of the present invention there is provided a golf tee or golf cup for securement to a golf practice putting platform and wherein the tee or cup are adapted to initiate a water jet or spray upon detection of a predetermined condition.

According to a broad aspect of the present invention there is provided a golf cup for securement in a golf practice putting surface. The golf cup comprises a cylinder defining a hollow chamber having a bottom end and a circular open top end. Securement means is provided for securing the golf cup to the putting surface with the open top end flush therewith. The cylinder has hand contact means connected therein to create a physical sensation to a hand placed in the cup when retrieving a golf ball therefrom.

According to a still further broad aspect of the present invention there is provided the miniature putting golf course having a plurality of putting surfaces with each surface having a golf tee area and a golf cup to receive a golf ball projected therein. The improvement comprises detection means to detect a predetermined condition associated with a person playing the golf course. A water jet is connected at a predetermined location and oriented to eject a water spray. A sensor is provided to sense the predetermined condition. A water valve is connected to water line feeding water to the water jet. Processing circuit means is responsive to the sensor to actuate the water valve and cause the water jet to eject the water spray.

BRIEF DESCRIPTION OF DRAWINGS

A preferred embodiment of the present invention will now be described with reference to the examples thereof as illustrated in the accompanying drawings in which.

DESCRIPTION OF PREFERRED EMBODIMENTS

Figure 1A:
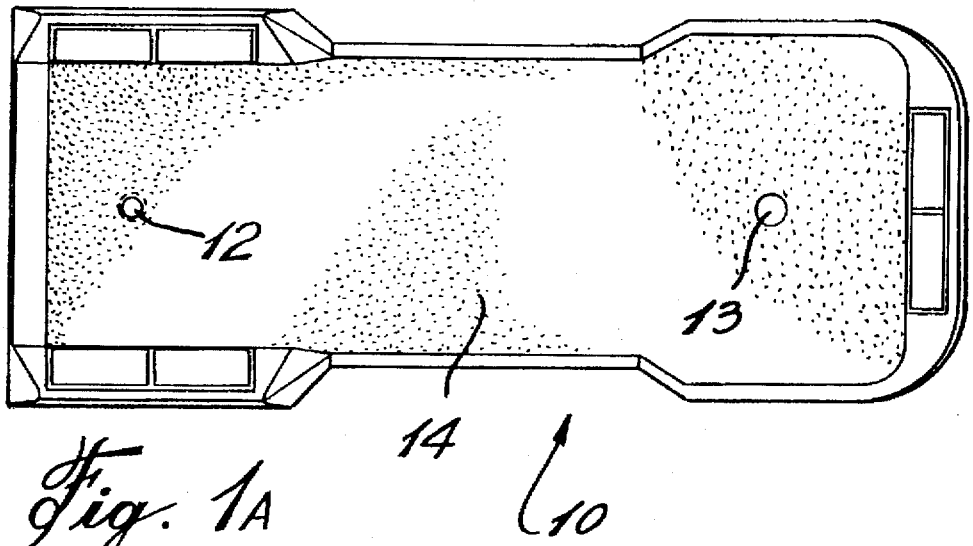
FIG. 1A is a top view of a golf putting platform, formed of sections, and having a golf ball support tee as well as a golf cup for receiving a golf ball therein.
Figure 1B:
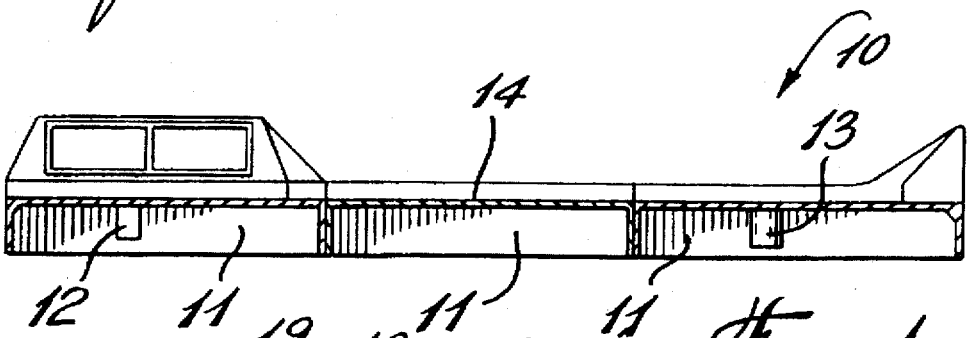
FIG. 1B is a side section view of FIG. 1A.

Referring now to the drawings, and particularly to FIGS. 1A and 1B, there is shown a golf practice putting platform 10 for use in an amusement golf putting course and constructed of platform sections 11 having different shapes and interconnected to form platform of different shapes and lengths. As herein shown, a golf ball support tee 12 is provided, usually at one end of the platform, and a golf cup 13 usually secured to an opposite end. The practice tee 12 as well as the golf cup 13 may be detachably secured to the putting surface 14 of the panels 11 and secured thereto by the underside thereof although they could be permanently fixed thereto.

Figure 1C:
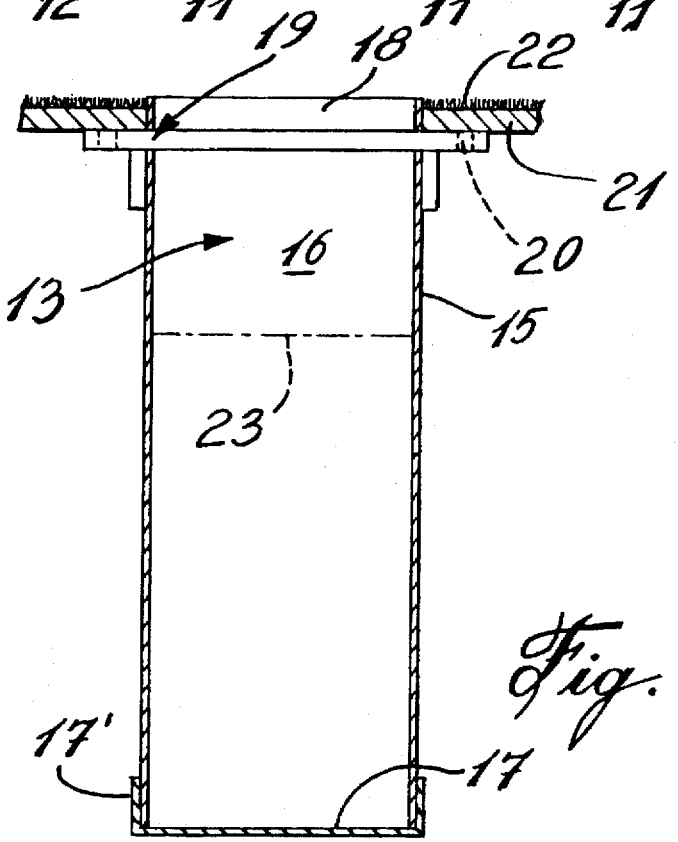
FIG. 1C is an enlarged view of the golf cup of FIG. 1B.

The golf cup 13 and the golf tee 12 as herein shown are constructed for ease of securement to these platforms and also for ease of adaptation thereto gadgetry of different types to induce laughter to the person or persons playing the putting game. As shown in FIG. 1C, the golf cup comprises a cylinder 15 which defines a hollow chamber 16 therein having a closed bottom end 17 and a circular open top end 18. Securement means in the form of a flange 19 having securement holes 20 therein is secured to the cylinder 15 spaced from the top end 18 to accommodate the top wall 21 and herein a grass-simulating carpet 22 thereabove which extends flush with the top end 18 of the cup. As herein shown, in order to induce laughter, the cylinder 15 is at least three times in length that of the diameter of the top open end and much deeper than the standard cup wherein its bottom wall would lie at a depth as illustrated by phantom line 23.

The cylinder 15 may be constructed from a length of plastic pipe of circular cross-section closed at the bottom end by a cap, herein schematically illustrated at 17'. As herein shown, the pipe extends to the open top end 18.

The present invention is concerned with adapting hand contact means inside the cup or water ejection means, both actuable upon detecting a predetermined condition or upon retrieval of a golf ball from the golf cup.

Figure 2:
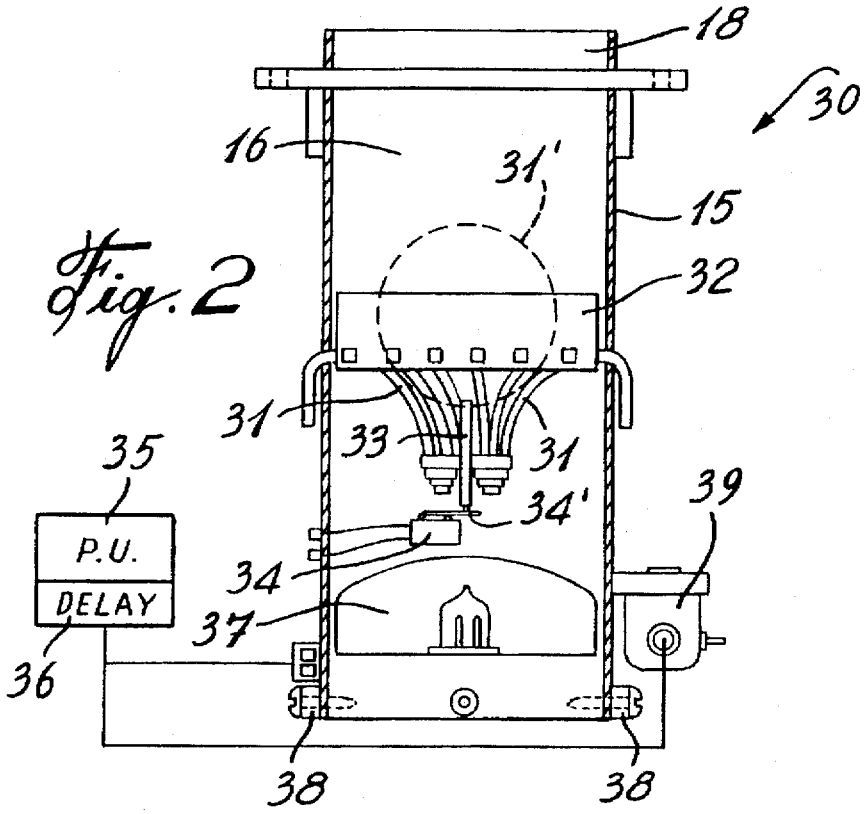
FIG. 2 is a sectional side view of a golf cup provided with gadgetry to simulate an electric shock after a predetermined time delay once a golf ball enters the golf cup.

FIG. 2 shows a laughter inducing golf cup 30 wherein the cylindrical side wall 15 is an elongated pipe, substantially as shown in FIG. 1C. As herein shown, a plurality of bare wires 31 form a bottom end of the chamber 16 and retained within an electrical junction box 32. These bare wires 31 are shaped to form a concave support wall to receive a golf ball and position same substantially centrally therein to engage a shaft 33 secured to a microswitch 34. Accordingly, when a ball falls within the golf cup 30 through the open end 18, it pushes the shaft 33 downwardly onto a spring contact 34' activating the microswitch 34 and sending a signal to the processor unit 35. The processing unit 35 is provided with a delay circuit 36 which sends an enabling signal to a strobe light 37 secured at the bottom end of the cylinder 15 by fasteners 38. Simultaneously, the delay circuit 36 also sends a signal to a vibrating solenoid 39 connected to the side wall of the cylinder 15. The strobe light will emit flashes of light and simultaneously the vibrating solenoid will vibrate the cup so that when the player places his hand within the cup to retract the ball, he will have the sensation that the wires 31 emit sparks, and that these are live wires. This will impart to the hand of the user when retrieving the ball, the sensation of an electric shock which will last for a predetermined period of time as programmed by the PU unit 35. This effect will be recycled by the PU unit 35 as long as the microswitch 34 remains closed by the presence of the ball applying pressure onto the shaft 33 which is biased upwardly by the spring contact 34' of the microswitch. The strobe light 37 and the vibrating solenoid 39 may also only be actuated by the PU unit 35 after the golf ball 31' is removed from the wires 31 wherein the shaft 33 will be pushed up.

Figure 3:
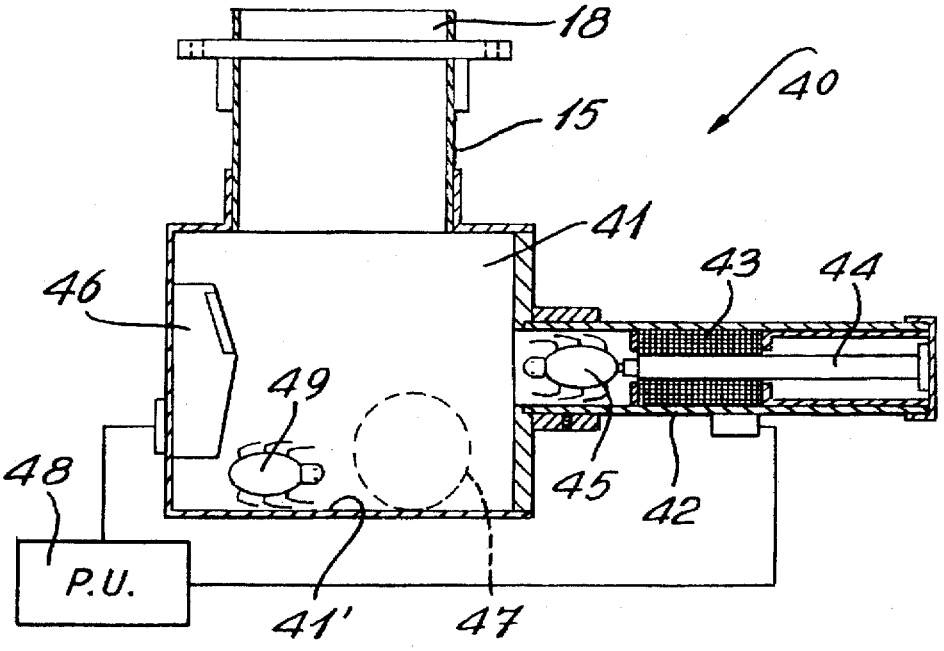
FIG. 3 is a sectional side view showing a golf cup with a displaceable artificial spider actuable when a player places his hand within the golf cup or when the ball enters the cup.

Referring to FIG. 3, there is shown generally at 40 a further golf cup constructed in accordance with the invention and wherein the cylinder 15 has an enlarged chamber 41 secured to the bottom end thereof. This chamber 41 provides for the cup 40 to have an increased depth. A cylindrical pipe 42 is connected to a side wall of the enlarged chamber 41 and has a solenoid 43 therein to activate a plunger 44. An artificial spider-like object 45 is secured to the end of the plunger 44, and when the plunger is actuated, it moves the object 45 inside the chamber 41 to a position substantially central therein. The solenoid 43 is actuated upon the detection of the hand of a player inserted within the cup 40 through the open top end 18. A motion detector 46 is provided in an opposed side wall of the enlarged chamber 41 to detect the hand. As soon as the hand enters the chamber to retrieve the golf ball 47, the sensor 46 sends a signal to the processor unit 48 to activate the solenoid 43 causing the spider-like object 45 to move and hit the hand of the player. One or more other spider-like objects 49 may also be secured over the bottom wall 41' of the enlarged chamber 41, or on its side wall, so that the player has the feeling that the chamber is filled with spiders. It is pointed out that the motion detector 46 is programmed to activate the plunger only when a large object is present, such as a hand, and will not activate the plunger when the ball 47 enters the cup.

Figure 4:
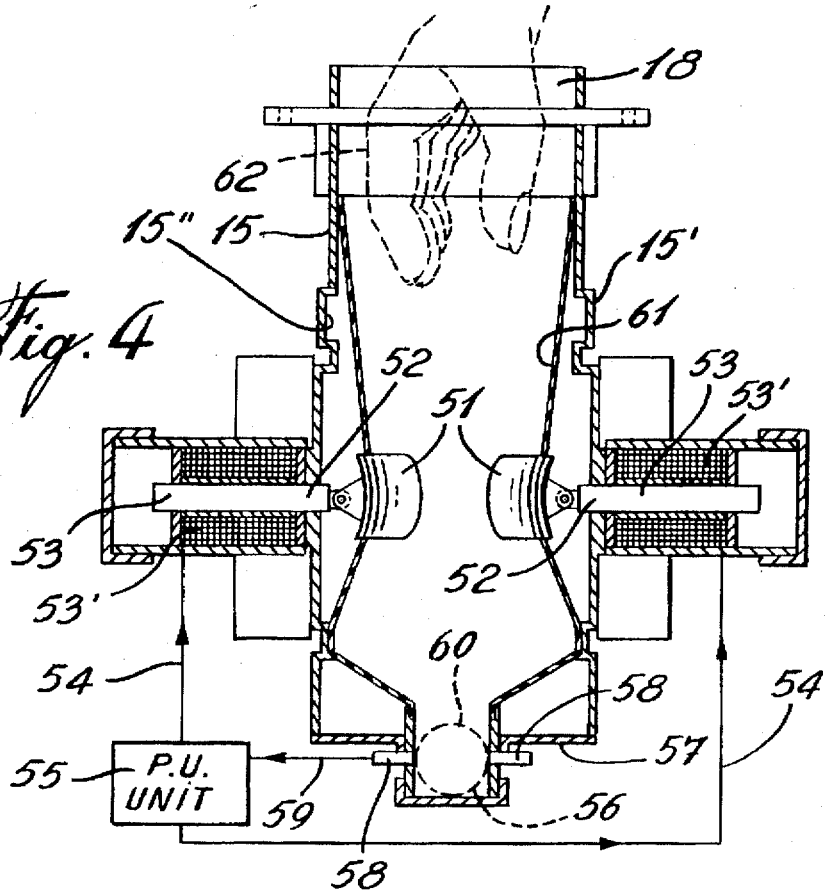
FIG. 4 is a sectional side view of a golf cup with a displaceable membrane and pads to apply grasping pressure to the hand of a player retrieving a a ball from the bottom of the cup.

Referring now to FIG. 4 there is shown generally at 50 a still further golf cup constructed in accordance with the present invention and wherein the cylinder 15 has an enlarged lower cylinder portion 15'. At least one, herein two hand engageable pads 51 are respectively secured to a solenoid rod end 52 of the solenoid rod 53 which is actuable by the solenoid 3 when an actuating voltage is connected thereto through the connection 54 and received from the processing unit 55. A ball receiving cavity 56 is provided in the bottom end portion 57 of the cylinder 15 and provided with sensors 58 which feed a signal to the processing unit 55 through its connection 59. As soon as a golf ball, such as shown at 60, enters the cavity 56 a signal is sent to the processing unit 55 placing the unit in a ready mode. The pads 51 are herein shown connected to a flexible sleeve or membrane 61 which is retracted against the inner side wall 15" of the cylinder 15 when the solenoids 53' are in the retracted position. As soon as the hand 62 of a player person is inserted within the cup opening 18 of the cylinder cup 15 and retrieves the golf ball 60 the absence of the ball 60 between the sensors 58 is again detected and this causes a voltage to be applied to the solenoid 53' actuating the pads to move inwardly towards the central longitudinal axis of the cup cylinder 15. This applies a light pressure on the hand of a user provoking a grabbing sensation on the hand. This induces laughter among the people playing the miniature putting hole.

Figure 5:
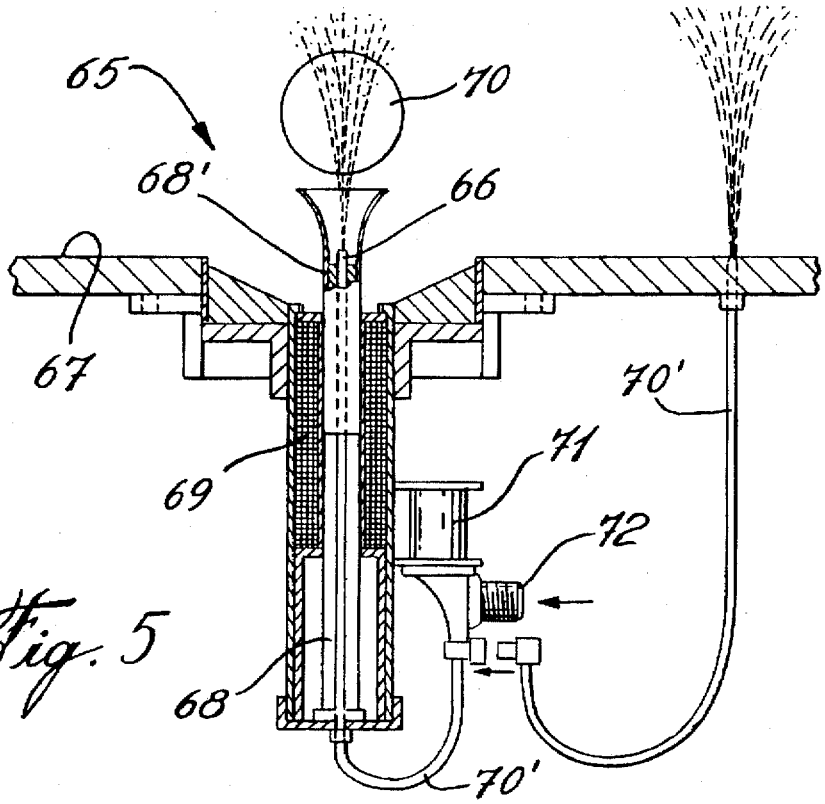
FIG. 5 is a sectional side view of a golf tee wherein the tee is adapted to cause the ball to fall off its support surface and simultaneously eject a jet of water axially of the tee or at a remote location from the tee.

Referring now to FIG. 5, there is shown generally at 65 a golf tee. The tee 65 is provided with an axial bore 66 throughout its length. A disc 67 surrounds the tee near a putting surface 67'. A cylinder rod 68 is actuable by the solenoid 69. A water hose 70 extends through the rod 68 and has a nozzle 68' located within the axial bore 66. Upon detection of the ball 70' on the tee or a player adjacent the tee detected by a sensor, (not shown), a processor unit will actuate a water valve 71 to momentarily open a gate (not shown) between a hose coupling 72 and the water hose 70 to cause a jet of water to spray out through the bore 66 of the tee. However, this is only effectuated at a predetermined time delay after the rod 68 has moved upwardly to eject the ball 70 off the tee 65. It is also conceivable that the water jet may have sufficient force to eject the ball off the tee and at the same time shoot out a jet of water which is timed to hit the player and induce laughter. A water hose 70' may also be connected remote from the tee and direct a water jet spray at a predetermined location to hit the player.

Figure 6:
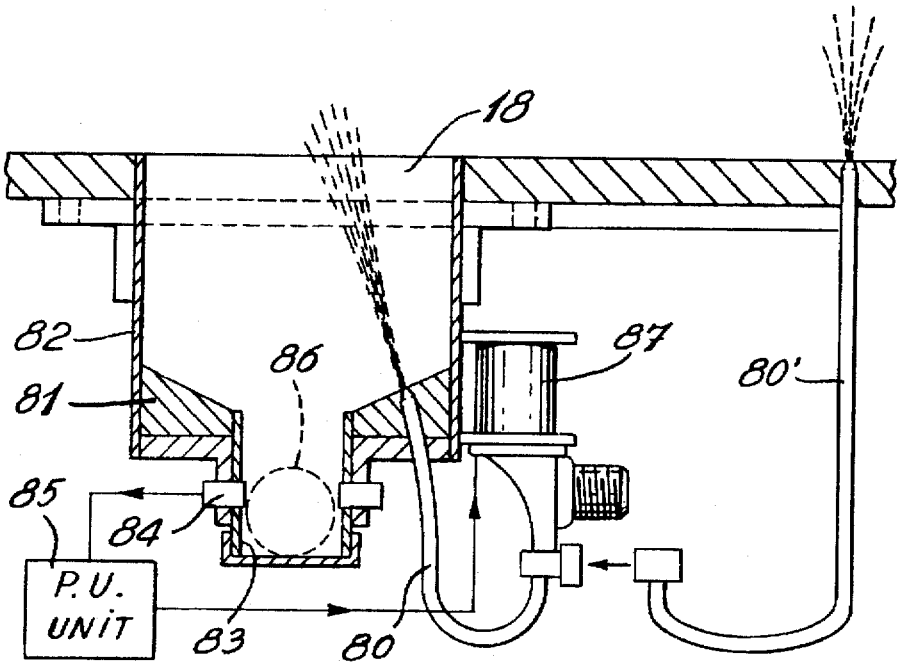
FIG. 6 is a sectional side view of a golf cup having a water jet associated therewith which is activated when a golf ball is retrieved from the cup.

FIG. 6 shows another alternative of the association of a water spray jet together with the miniature putting golf course. As herein shown, the water jet 80 may be secured directly into a bottom wall portion 81 of the golf cup 82. The bottom of the cup has a cavity 83 in which the ball enters. Sensors 84 detect the presence of the ball and conditions the processing circuit 85. As soon as the ball 86 is lifted by the player person from the cavity 83, the processing circuit 85 will feed a voltage signal to the water valve 87 to initiate a water spray outwardly through the open end 18 of the golf cup 82 and in the direction of the player. Again, as with the golf tee, the water hose 80' may also be removed from the golf cup 82 and angulated at a position whereby to direct a water jet at the player person.

Figure 7:
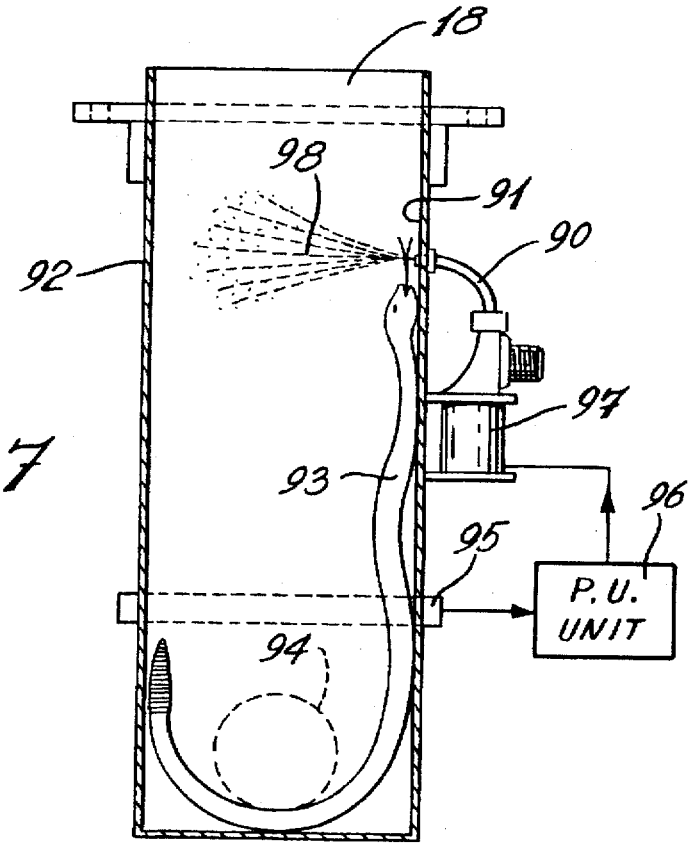
FIG. 7 is a sectional side view of a golf cup having a snake-like gadgetry mounted therein and a water jet which is activated when a golf ball is retrieved from the cup.

As shown in FIG. 7, the water jet 90 is herein positioned adjacent a side wall portion 91 of a cup cylinder 92 and spaced from the top open end 18 thereof. A creature-like object, herein an artificial snake 93 is secured within the golf cup cylinder, which is herein an elongated cylinder sufficiently long to accommodate the creature-like object 93. After the golf ball 94 enters the cup cylinder 92 through the open end 18, it lodges itself at the bottom of the cylinder. When the user person places his hand in the cylinder, sensors 95 detect the presence of the hand and send a signal to the processing circuit 96 which in turn actuates the water valve 97 to direct a narrow impinging stream of water 98 in the direction of the hand or arm of the player person to simulate a sharp sensation such as a snake bite. It can therefore be appreciated that water jets may be incorporated with the golf tees or golf cups or with sensors whereby to direct a water spray at the player or other players on the miniature golf course whereby to induce laughter and to simulate actions such as snake bites.

It is within the ambit of the present invention to cover any obvious modifications of those examples as described herein above. Those skilled in the art will appreciate that the conception, upon which this disclosure is based, may readily be utilized as a basis for the construction of other golf cups or golf tees for carrying the several purposes of the present invention. It is therefore important to note that the claims be regarded as including such equivalent constructions insofar as they do not depart from the spirit and scope of the present invention.

I claim:

1. A golf cup for securement in a golf practice putting surface, said golf cup comprising a cylinder defining a hollow chamber having a bottom end and a circular open top end, securement means for securing said golf cup to said putting surface with said open top end flush therewith, said cylinder having hand contact means connected therein to create a physical sensation to a hand placed in said cup when retrieving a golf ball therefrom.

2. A golf cup as claimed in claim 1, wherein said hand contact means is a solenoid activated plunger secured to a side wall of said cylinder and spaced from said open top end, an artificial creature-like object secured to a free end of said plunger and retracted in said housing, said solenoid being activated upon the detection of a hand inserted into said cylinder at a predetermined location whereby to extend said plunger momentarily out of said housing to cause said creature-like object to touch said hand to create said sensation.

3. A golf cup as defined in claim 2 wherein said hand is detected by a motion detector device secured to said side wall of said cylinder.

4. A golf cup as defined in claim 3 wherein at least one further creature-like object is secured to a bottom wall of said cylinder in an enlarged chamber at a bottom end portion thereof, said housing being a cylindrical housing secured a predetermined distance spaced above said bottom wall.

5. A golf cup as defined in claim 1 wherein said hand contact means is a plurality of bare wires shaped to form a concave support wall secured inside said cylinder, said concave support wall receiving a golf ball thereon when entering said open top end, and detection means to detect the presence of a golf ball on said concave support wall, a processing unit connected to said detection means and having control means to activate a strobe light secured in said bottom end of said golf cup and a vibrating solenoid connected to a side wall of said cup upon detection of said ball or upon retrieval thereof.

6. A golf cup as defined in claim 5 wherein said detection means is a shaft having a top end extending above said concave support wall and axially displaceable when a golf ball is present on said support wall, said shaft having an opposed bottom end disposed for actuation of a microswitch to provide a signal to said processing unit indicating the presence of said golf ball.

7. A golf cup as defined in claim 6 wherein said processing unit is provided with a delay circuit to actuate said strobe light and vibrating solenoid at a predetermined time delay to simulate an electric shock substantially during a period of time when said ball is anticipated to be removed from said cup.

8. A golf cup as defined in claim 7 wherein said processing unit monitors said microswitch and actuates said strobe light and vibrating solenoid only when said ball is retrieved and said microswitch re-assumes an open contact condition.

9. A golf cup as defined in claim 1 wherein said hand contact means is constituted by at least one pad mounted on a solenoid rod end and actuated to move towards a central axis of said cylinder by processing circuit means when a golf ball is retrieved from a bottom end portion of said cylinder.

10. A golf cup as defined in claim 9 wherein there is a pair of said pads mounted on respective diametrically opposed solenoid rod ends of a pair of solenoids secured on opposed side wall portions of said cylinder.

11. A golf cup as defined in claim 10 wherein said cylinder is provided with a ball receiving cavity in said bottom end portion, sensing means associated with said ball receiving cavity and feeding detecting signals to said processing circuit means.

12. A golf cup as defined in claim 10 wherein a flexible sleeve is secured inside said cylinder, said sleeve being secured to said pads.

13. A golf cup as defined in claim 1 wherein said hand contact means is constituted by a creature-like object secured within said cylinder, and a water jet connected to a water valve, said water valve being actuated by processing circuit means upon detecting of a hand inserted into said cylinder, said water jet when impinging upon said hand giving the sensation of a bite from said creature-like object.

14. A miniature putting golf course having a plurality of putting surfaces, each said surfaces having a golf tee area and a golf cup to receive a golf ball projected therein, the improvement comprising detection means to detect a predetermined condition associated with a person playing said golf course, a water jet connected at a predetermined location and oriented to eject a water spray, a sensor to sense said predetermined condition, a water pressurized supply connected to a water line feeding water to said water jet, and processing circuit means responsive to said sensor to actuate said water valve and cause said water jet to eject said water spray.

15. A miniature putting golf course as defined in claim 14 wherein said water jet is mounted in said golf cup and positioned to eject said water spray outwardly thereof, said cup having a ball receiving cavity in a lower end thereof, said sensor being secured in said cavity.

16. A miniature putting golf course as defined in claim 14 wherein said water jet is located exteriorly and in relation to said golf cup and positioned to eject said water spray outwardly thereof, said cup having a ball receiving cavity in a lower end thereof, said sensor being secured in said cavity.

17. A golf cup as defined in claim 14 wherein said golf tee is provided with an axial bore therein, a water hose secured to a nozzle connected to said axial bore, an water valve secured to said water hose, said water valve when operated momentarily causing a water spray to come out of said axial bore in a top end of said tee.

* * * * *